US007536141B2

(12) United States Patent
Miyoshi

(10) Patent No.: US 7,536,141 B2
(45) Date of Patent: May 19, 2009

(54) DEVELOPING DEVICE, PROCESS CARTRIDGE AND IMAGE FORMING APPARATUS

(75) Inventor: Yasuo Miyoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 471 days.

(21) Appl. No.: 11/395,186

(22) Filed: Apr. 3, 2006

(65) Prior Publication Data

US 2006/0228135 A1 Oct. 12, 2006

(30) Foreign Application Priority Data

Apr. 11, 2005 (JP) ..... 2005-112989

(51) Int. Cl.
*G03G 15/09* (2006.01)

(52) U.S. Cl. ..... 399/277

(58) Field of Classification Search ..... 399/267, 399/277

See application file for complete search history.

(56) References Cited

U.S. PATENT DOCUMENTS 5,491,541 A * 2/1996 Yokoyama et al. ..... 399/277
5,619,765 A 4/1997 Tokita et al.
5,638,842 A 6/1997 Tokita et al.
6,067,433 A * 5/2000 Kimura et al. ..... 399/277 X
6,505,014 B2 1/2003 Aoki et al.
6,658,227 B2 12/2003 Oyama et al.
6,671,484 B2 12/2003 Miyoshi et al.
6,721,516 B2 4/2004 Aoki et al.
6,782,225 B2 8/2004 Kai et al.
6,873,814 B2 * 3/2005 Ohjimi et al. ..... 399/267 X
6,901,233 B2 5/2005 Aoki et al.
2004/0234299 A1 * 11/2004 Koetsuka et al. ..... 399/267
2005/0002701 A1 1/2005 Ikeguchi et al.
2005/0135843 A1 * 6/2005 Kakegawa et al. ..... 399/277 X
2006/0002744 A1 1/2006 Aoki et al.

(Continued)

FOREIGN PATENT DOCUMENTS

JP 6-64396 8/1994

(Continued)

OTHER PUBLICATIONS

U.S. Appl. No. 11/950,581, filed Dec. 5, 2007, Miyoshi.

(Continued)

*Primary Examiner*—Sandra L Brase
(74) *Attorney, Agent, or Firm*—Oblon, Spivak, McClelland, Maier & Neustadt, P.C.

(57) ABSTRACT

A developing device of the present invention includes a photosensitive drum and a developing roller facing the drum. The developing roller accommodates a stationary magnet roller that forms on the surface of the developing roller a scoop-up pole for scooping up the developer stored in the developing device onto the developing roller and a release pole adjoining the scoop-up pole for causing part of the developer moved away from a developing zone to be released from the developing roller between it and the scoop-up pole. The scoop-up pole, which is of the same polarity as the release pole, is configured such that a position where the flux density thereof in the direction normal to the surface of the developing roller is maximum is located closer to the release pole than a position on the above surface corresponding to the center of a range in which the above flux density is halved.

8 Claims, 7 Drawing Sheets

U.S. PATENT DOCUMENTS

| | | | |
|---|---|---|---|
| 2006/0008297 | A1 | 1/2006 | Oyama et al. |

FOREIGN PATENT DOCUMENTS

| | | |
|---|---|---|
| JP | 2505814 | 4/1996 |
| JP | 10-142919 | 5/1998 |
| JP | 2000-194194 | 7/2000 |
| JP | 2000-206741 | 7/2000 |
| JP | 2001-75363 | 3/2001 |
| JP | 2002-40811 | 2/2002 |

OTHER PUBLICATIONS

U.S. Appl. No. 11/843,168, filed Aug. 22, 2007, Miyoshi.
U.S. Appl. No. 11/848,961, filed Aug. 31, 2007, Miyoshi.

* cited by examiner

Comparative Example

FIG. 9

| | CARRIER SATURATION MAGNETIZATION MOMENT (emu/g) | | | |
|---|---|---|---|---|
| | 25 | 45 | 65 | 95 |
| EXAMPLE | △ | ○ | ○ | ○ |
| COMPARATIVE EXAMPLE | × | △ | ○ | ○ |

DEVELOPING DEVICE, PROCESS CARTRIDGE AND IMAGE FORMING APPARATUS

BACKGROUND OF THE INVENTION

1. Field of the Invention

The present invention relates to a developing device for developing a latent image formed on an image carrier and a process cartridge and an image forming apparatus including the same each and more particularly to a developing device using a two-ingredient type developer, i.e., a toner and carrier mixture and a process cartridge and image forming apparatus including the same each.

2. Description of the Background Art

It is a common practice with a copier, printer, facsimile apparatus, multifunction machine or similar electrophotographic image forming apparatus to use a developing device storing a two-ingredient type developer made up of toner particles and magnetic carrier particles with or without additives, as disclosed in, e.g., Japanese patent laid-open publication No. 2000-194194. Today, there is an increasing demand for the size reduction of the developing device of the type described as well as the extension of the life of the developer.

More specifically, the developing device includes a developing roller or developer carrier, two screw or conveying members and a doctor blade. In operation, fresh toner replenished to the developer is circulated by the screws in the lengthwise direction of the device, i.e., in parallel to the axial direction of the developing roller and mixed with the developer thereby. Part of the developer thus mixed is scooped up onto the developing roller, which faces one of the screws, by the developer and a magnetic scoop-up pole formed on the developing roller. The developer on the developing roller is then metered by a doctor blade to an adequate amount. When the developing roller comes to face a photoconductive drum or image carrier, the toner in the developer is transferred to a latent image formed on the drum for thereby developing the latent image. Subsequently, part of the developer on the developing roller moved away from the position where it faces the drum is released from the roller at a position between a magnetic release pole and the scoop-up pole and again returned to the developing device.

On the other hand, Japanese patent laid-open publication No. 2002-40811, for example, proposes to optimize a meter pole and a developer release or peel-off pole formed on a developing roller for the purpose of extending the life of a photoconductive drum and controlling irregularities in image density coincident with the pitch of screws. However, even the scheme taught in the above document cannot insure stable images against aging, as will be described more specifically hereinafter.

When the flux density of a scoop-up pole formed on a developer carrier or developing roller is high, a developer is apt to accumulate around a so-called doctor gap between the developer carrier and a doctor blade although a sufficient amount of developer can be deposited on the developer carrier. The developer, accumulating around the doctor gap, is subject to a heavy physical load and therefore shortened in life due to deterioration. This is particularly true with a small-size developing device in which various structural parts and elements are densely packed.

On the other hand, when the flux density of the scoop-up electrode is low, the developer accumulates around the doctor gap little and is therefore not subject to a heavy physical load, but the developer cannot be deposited on the developer carrier in a sufficient amount. When the amount of the developer deposited on the developer carrier is reduced, irregularities in density are apt to appear in the resulting toner image in accordance with the pitch of the screw or conveyor member facing the developer carrier.

Further, it is necessary that part of the developer deposited on the developer carrier and just moved away from a developing zone be surely released from the developer carrier between the release electrode and the scoop-up electrode. More specifically, the developer passed through the developing zone is unstable in charge condition. If the developer in such an unstable charge condition is not released from the developer carrier, then it is mixed with the other part of the developer scooped up by the scoop-up pole in a desirable charge condition, rendering the charge condition of the entire developer unstable. The resulting developer would form a toner image with an irregular density distribution when again brought to the developing position.

Particularly, in a small-size developing device, a plurality of magnetic poles are density arranged on the developer carrier, so that the developer cannot be surely released from the developer carrier at a position upstream of the scoop-up pole due to the influence of the magnetic force of the scoop-up pole.

Laid-open publication No. 2002-40811 mentioned earlier differs from the configuration stated above in that the developer carrier is rotated in the opposite direction and that the doctor blade is positioned below the developer carrier. This configuration allows a certain amount of developer to be deposited on the developer carrier without resorting to the is it scoop-up electrode on the developer carrier. However, it is not practicable to directly solve the problems ascribable to the size of the flux density of the scoop-up pole.

Technologies relating to the present invention are also disclosed in, e.g., Japanese patent laid-open publication Nos. 06-064396 and 10-142919 and Japanese Patent No. 2,505,814.

SUMMARY OF THE INVENTION

It is an object of the present invention to provide a developing device capable of controlling irregular image density and other image defects even when reduced in size and extending the life of a developer for thereby insuring stable high-quality images against aging, a process cartridge and an image forming apparatus.

A developing device of the present invention is configured to develop a latent image formed on an image carrier with a developer carrier facing the image carrier and allowing a developer to deposit thereon. The developer carrier accommodates a stationary magnet roller for forming on the surface of the developer carrier a scoop-up pole for scooping up the developer stored in the developing device onto the developer carrier and a release pole adjoining the scoop-up pole for causing part of the developer moved away from a developing zone where the developer carrier and image carrier face each other to be released from the developer carrier between the release pole and the scoop-up pole. The scoop-up pole and release pole are of the same polarity as each other. The scoop-up pole is configured such that a position where a flux density of the scoop-up pole in the direction normal to the surface of the developer carrier is maximum is located closer to the release pole than a position on the above surface corresponding to the center of a range in which the above flux density is halved.

A process cartridge and an image forming apparatus using the above developing device each are also disclosed.

BRIEF DESCRIPTION OF THE DRAWINGS

The above and other objects, features and advantages of the present invention will become more apparent from the following detailed description taken with the accompanying drawings in which:

FIG. 9 is a table listing experimental results showing a relation between the saturation magnetization characteristic of a carrier and irregularities in image density.

DESCRIPTION OF THE PREFERRED EMBODIMENTS

Figure 1:
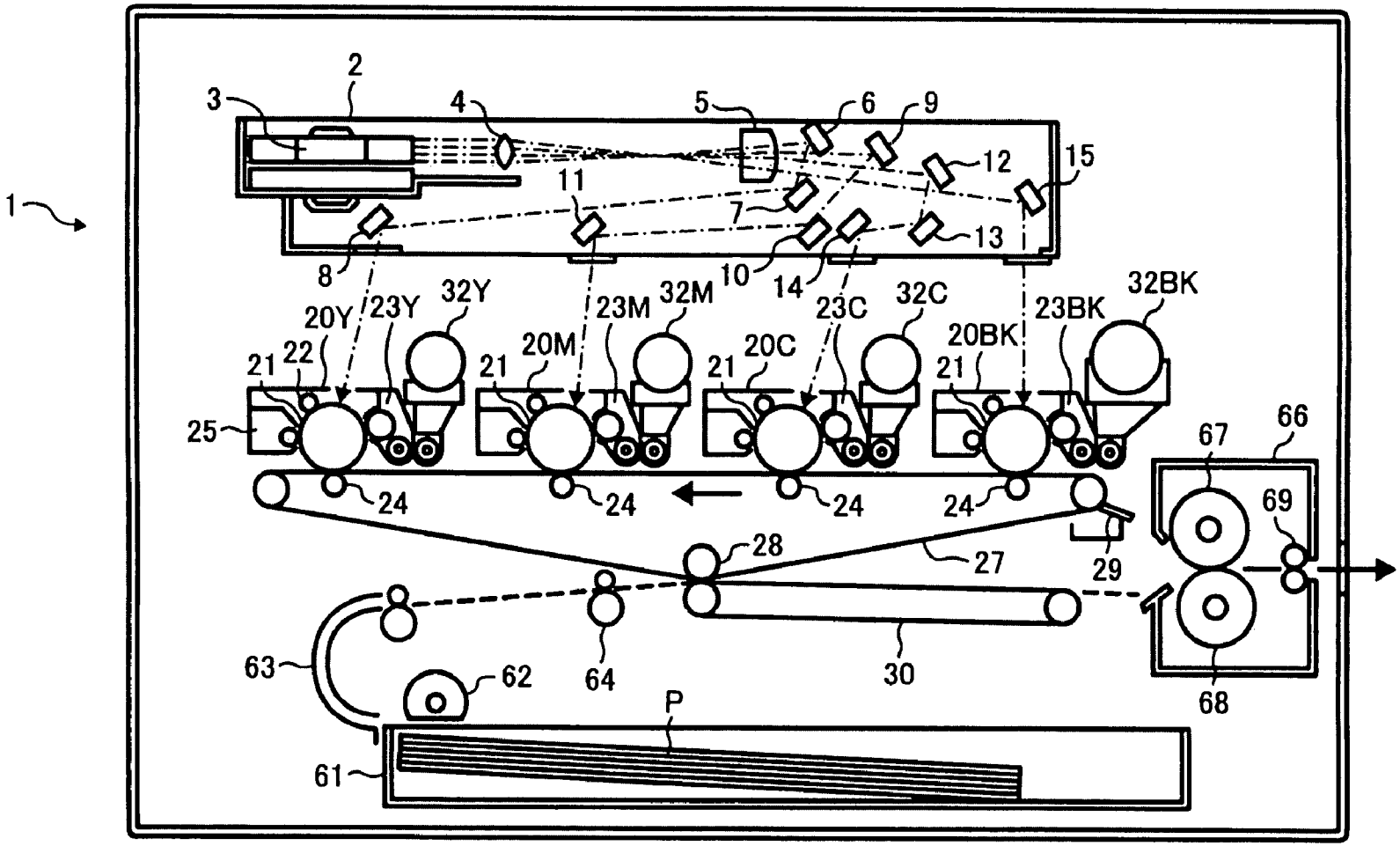
FIG. 1 is a view showing the general construction of an image forming apparatus embodying the present invention.

To begin with, I found the following as a result of researches and experiments conducted to solve the problems stated previously. When the scoop-up pole and release pole were of the same polarity, i.e., north pole or south pole, the developer after the development could be easily released from the developer carrier even if the two poles were positioned closed to each other. Further, when a position where the flux density of the scoop-up pole in the normal direction was maximum was not coincident with the center of a range in which the above flux density was halved, but was shifted toward the release pole side, the scoop-up pole could scoop up a relatively great amount of developer even if the overall flux density of the scoop-up pole was low.

In the following description, the term "process cartridge" refers to a unit removably mounted to an apparatus body and including at least one of a charger for charging an image carrier, a developing device or section for developing a latent image formed on the image carrier and a cleaner for cleaning the image carrier and the image carrier. In the figures, identical structural elements are designated by identical reference numerals, and a detailed description thereof will not be made in order to avoid redundancy.

Referring to FIG. 1 of the drawings, an image forming apparatus embodying the present invention is shown and implemented as a color printer by way of example. As shown, the color printer includes a casing or printer body 1. A scanner or optical writing unit 2 is configured to selectively emit a laser beam in accordance with Y (yellow), M (magenta) , C (cyan) or BK (black) image data. Process cartridges 20Y, 20M, 20C and 20BK, assigned to a particular color each, each include a photoconductive drum or image carrier 21 and a charger 22 for uniformly charging the surface of the drum 21. A developing device or section 23Y, 23M, 23C or 23BK develops a latent image formed on the drum 21. Bias rollers for primary image transfer 24 are arranged for transferring toner images thus formed on the drums 21 by the corresponding developing devices 23Y through 23BK to an intermediate image transfer belt 27 one above the other, so that a composite or full-color toner image is completed on the belt 27. Drum cleaners 25, adjoining a particular drum 21 each, remove toner left on the drum 21 after the image transfer each.

A bias roller for secondary image transfer 28 is configured to transfer the composite or full-color toner image formed on the intermediate image transfer belt 27 to a paper sheet or similar recording medium P. A belt cleaner 29 removes toner left on the intermediate image transfer belt 27 after the image transfer. A belt conveyor 30 conveys the paper sheet P carrying the full-color toner image thereon to a fixing unit 66. Toner replenishing sections 32Y, 32M, 32C and 32BK replenish Y toner, M toner, C toner and BK toner to the developing sections 23Y, 23M, 23C and 23BK, respectively. A sheet feeding section 61 is loaded with a stack of paper sheets P thereon.

In the illustrative embodiment, the process cartridges 20Y, 20M, 20C and 20BK each are constituted by the respective drum 21, charger 22 and drum cleaner 25 and replaced with a new process cartridge at a preselected cycle. Also, the developing devices 23Y through 23BK are replaced at a preselected cycle each.

A yellow image, a magenta image, a cyan image and a black image are respectively formed on the drums 21 of the process cartridges 20Y, 20M, 20C and 20BK.

The operation of the color printer 1 in an ordinary color mode will be described hereinafter. The four drums 21 each are rotated at a linear velocity of 200 mm/sec counterclockwise as viewed in FIG. 1. The surface of each drum 21 in rotation is first uniformly charged by the charger 22 to −350 V. Subsequently, the charged surface of each drum 21 is exposed by a laser beam emitted from the scanner 2 in accordance with an image signal of a particular color. More specifically, color-by-color laser beams emitted from a light source are reflected by a polygonal mirror 3, then transmitted through lenses 4 and 5 and then propagated through a respective optical path each.

The laser beam, corresponding to a yellow component, is sequentially reflected by mirrors 6, 7 and 8 and then incident on the charged surface of the drum 21 of the process cartridge 20Y, which is positioned at the leftmost side in FIG. 1. At this instant, the yellow laser beam is scanned by the polygonal mirror 3, which is in rotation at high speed, in the axial direction of the drum 21 or main scanning direction. As a result, a latent image representative of the yellow component is formed on the charged surface of the drum 21.

Likewise, a laser beam, corresponding to a magenta component, is sequentially reflected by mirrors 9, 10 and 11 and then incident on the charged surface of the drum 21 included in the second process cartridge 20M as counted from the left of FIG. 1, forming a latent image corresponding to the magenta component on the drum 21. A laser beam, corresponding to a cyan component, is sequentially reflected by mirrors 12, 13 and 14 and then incident on the charged surface of the drum 21 included in the third process cartridge 20C as counted from the left of FIG. 1, forming a latent image corresponding to the cyan component on the drum 21. Further, a laser beam corresponding to a black component, is reflected by a mirror 15 and then incident on the charged surface of the drum 21 included in the fourth process cartridge 20BK as counted from the left of FIG. 1, forming a black latent image on the drum 21.

When the drum 21, carrying the latent image corresponding to the yellow component, is rotated to a position where it faces the developing device 23Y, the developing device 23Y develops the latent image with yellow toner to thereby form a yellow toner image. This is also true with the drums 21 carrying the latent images corresponding to the magenta, cyan and black components except that they are processed by the developing devices 23M, 23C and 23BK.

The bias rollers for image transfer 24 are held in contact with the inner surface of the intermediate image transfer belt 27 in such a manner as to face the drums 21. In this condition, the yellow, magenta, cyan and black toner images are sequentially transferred from the drums 21 to the intermediate image transfer belt 27 one above the other, completing a full-color image on the belt 27. This image transfer will be referred to as primary image transfer hereinafter.

After the primary image transfer, the drum cleaner 25 removes toner left on the corresponding drum 21, i.e., cleans the surface of the drum 21. This is the end of an image forming process executed with each drum 21.

On the other hand, while the intermediate image transfer belt (simply belt hereinafter) 27 is turning in a direction indicated by an arrow in FIG. 1, part of the surface of the belt 27 carrying the full-color toner image thereon is brought to the position where the bias roller for secondary image transfer 28 is located. The bias roller 28 transfers the full-color toner image from the belt 27 to the paper sheet P. This image transfer will be referred to as secondary image transfer hereinafter. Subsequently, the belt cleaner 29 collects toner left on the belt 27 after the secondary image transfer, completing an image transfer process executed with the belt 27.

The paper sheet P is fed from the sheet feeding section 61 by a pickup roller 62 to a registration roller pair 64 via a guide 63. The registration roller pair64 once stops the paper sheet P in order to correct its skew and then conveys it toward the bias roller for secondary image transfer 28 in synchronism with the full-color toner image carried on the belt 27.

The paper sheet P, now carrying the full-color image thereon, is conveyed to the fixing unit 66 by the belt conveyor 30. The fixing unit 66, having a conventional configuration, fixes the full-color toner image on the paper sheet P with a heat roller 67 and a press roller 68. Finally, the paper sheet or print P is driven out of the printer body 1 by an outlet roller pair 69, completing an image forming process.

Figure 2:
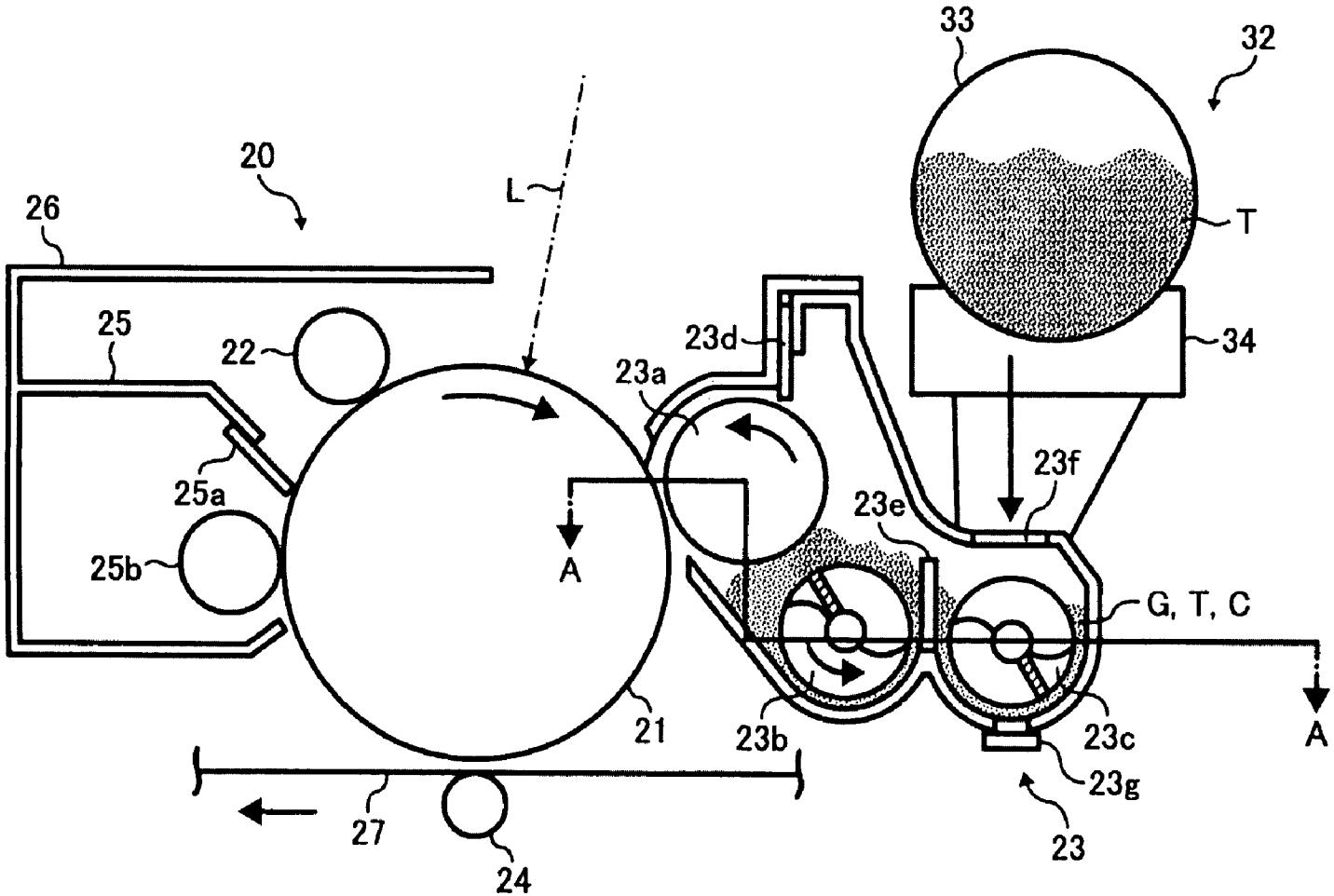
FIG. 2 is a section showing a specific configuration of an image forming section included in the illustrative embodiment.
Figure 3:
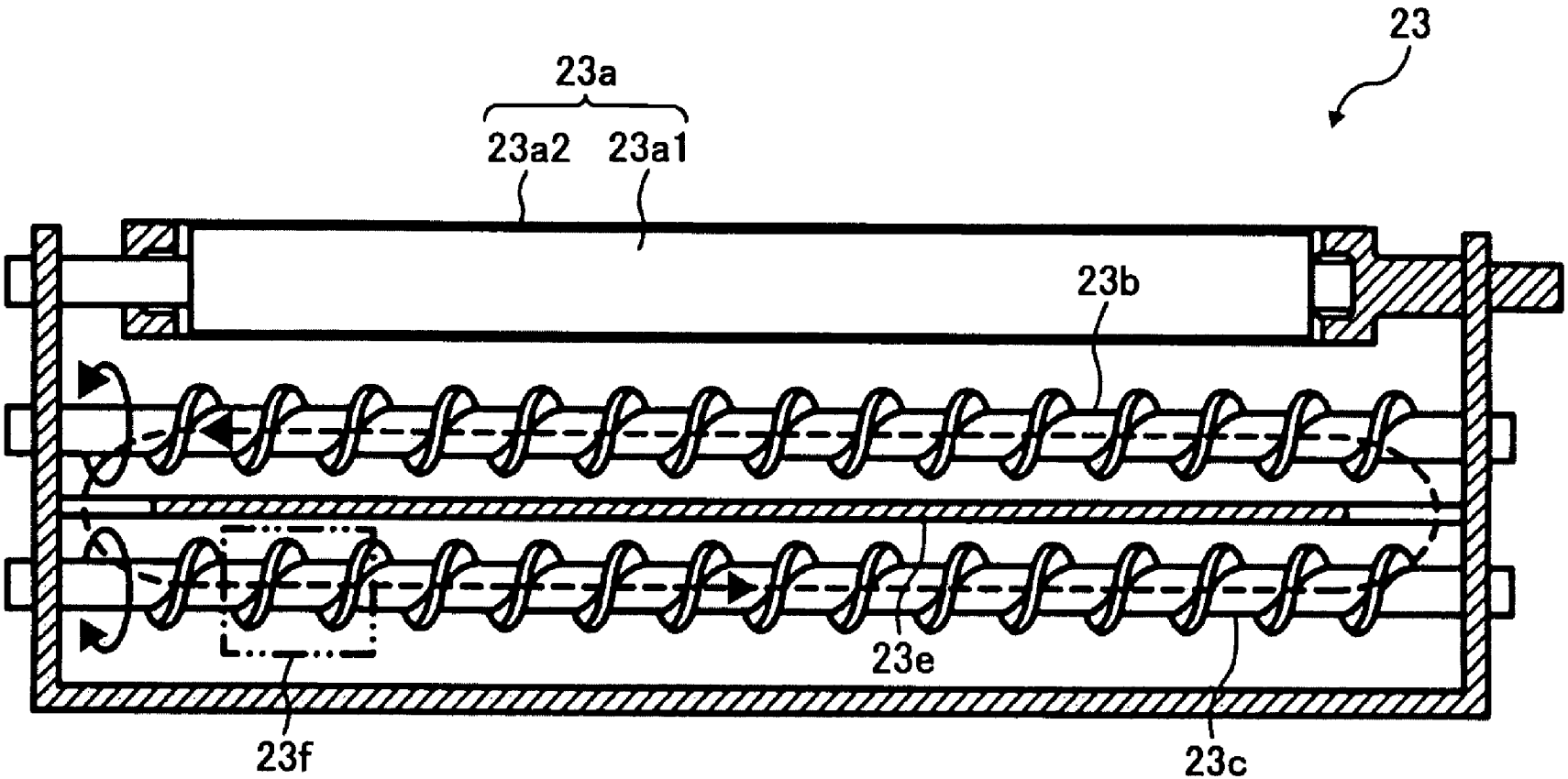
FIG. 3 is a section along line A-A of FIG. 2.

Reference will be made to FIGS. 2 and 3 for describing an image forming section included in the illustrative embodiment more specifically. FIG. 2 shows the image forming section in a section while FIG. 3 shows it in a section along line A-A of FIG. 2. Because four image forming sections mounted on the printer body 1 are substantially identical in structure with each other except for the color of toner T, the suffices Y, M, C and BK attached to the process cartridges, developing devices and toner replenishing sections will be omitted hereinafter.

As shown in FIG. 2, the process cartridge 20 includes a casing 26 on which mainly the drum or image carrier 21 with an outside diameter of 50 mm, charger 22 and drum cleaner 25 are mounted together. The drum cleaner 25 is implemented by a cleaning blade 25*a* and cleaning roller 25*b* contacting the drum 21 each.

The developing device or section 23 mainly consists of a developing roller or developer carrier 23*a* facing the drum 21, a first screw or conveying means 23*b* facing the developing roller 23*a*, a second screw 23*c* facing the first screw 23*b* via a partition member 23*a*, a doctor blade 23*d* facing the developing roller 23*a* and a toner content sensor 23*g* responsive to the toner content of a developer G stored in the developing device 23. The developer G is a two-ingredient type developer made up of magnetic carrier particles C and toner particles T. As shown in FIG. 3, the developing roller 23*a* is made up of a rotatable sleeve 23*a*2 and a stationary magnet roller 23*a*1 disposed in the sleeve 23*a*2. A plurality of magnetic poles are formed on the surface of the magnet roller 23*a*1, which is provided with an outside diameter of 18 mm.

The image forming process stated earlier will be described more specifically with reference to FIGS. 2 and 3, concentrating on the developing step. The developing roller 23*a* is rotated at a linear velocity of 300 mm/sec in a direction indicated by an arrow in FIG. 2. As shown in FIG. 3, the developer G in the developing device 23 is mixed with fresh toner T, which is replenished from the toner replenishing section 32 via a port 23*f*, by being agitated by the first and second screws 23*b* and 23*c* that adjoin each other with the intermediary of the partition member 23*e* and are rotated in directions indicated by arrows. In this condition, the developer G is circulated in the axial direction of the screws 23*b* and 23*c* indicated by dashed arrows in FIG. 3. It is to be noted that the first screw 23*b* is provided with an outside diameter of 12 mm and spaced from the axis of the developing roller 23*a* by 14 mm.

Figure 4A:
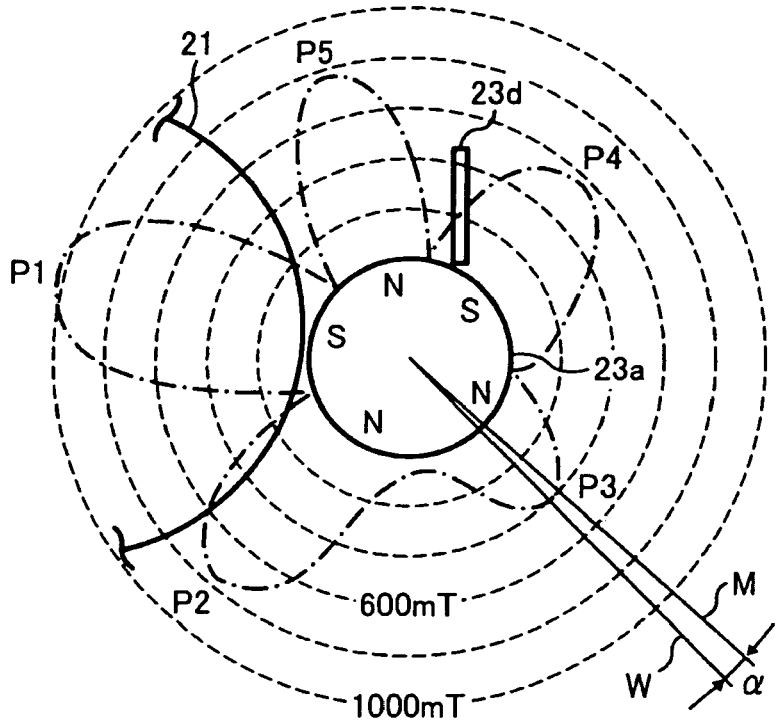
FIG. 4A is a chart showing flux density distributions formed on a developing roller included in a developing device characterizing the illustrative embodiment.
Figure 4B:
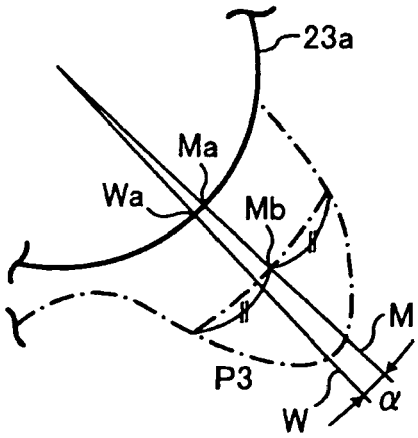
FIG. 4B is a fragmentary section showing part of the flux density distributions of FIG. 4A in an enlarged scale.

The toner T thus electrified to −10 μC/g to −25 μC/g and deposited on the carrier C is scooped up onto the developing roller 23*a* together with the carrier C by a magnetic scoop-up pole P3, see FIGS. 4A & 4B, formed on the developing roller 23*a*.

The magnet roller 23*a*1 forms a plurality of magnetic poles on the surface of the sleeve 23*a*2 of the developing roller 23*a*. More specifically, a shown in FIG. 4A, the magnet roller 23*a*1 is made up of three north-pole magnets and two south-pole magnets. Such magnets form on the sleeve 23*a*2 flux density distributions in the form of the scoop-up pole P3 for scooping up the developer G onto the sleeve 23*a*2, a convey pole P4 for conveying the developer deposited on the sleeve 23*a*2 to the doctor blade 23*d*, a convey pole P5 for conveying the developer G to a developing zone, which will be described later specifically, a main pole P1 positioned in the developing zone, and a release pole P2 for releasing the developer G moved away from the developing zone from the sleeve 23*a*2. Such flux distributions cause the developer G to move in accordance with the rotation of the sleeve 23*a*2.

Referring again to FIG. 2, the toner replenishing section 32 is implemented by a toner bottle removably mounted to the printer body 1 and a toner hopper 34 supporting and driving the toner bottle 33 in order to replenish fresh toner T to the developing device 23. The toner bottle stores one of yellow toner, magenta toner, cyan toner or black toner to be so replenished to the developing device 23. A spiral ridge is formed on the inner surface of the toner bottle 33.

The toner T in the toner bottle 33 is suitably replenished to the developing device 23 via the port 23*f* in accordance with the consumption of toner T stored in the developing device 23. The toner content sensor 23*g* senses the toner content of the developer G in the developing device 23 in terms of permeability. The port 23*f* is positioned above the second screw 23*c* at one axial end of the second screw 23*c* in the right-and-left direction in FIG. 3.

In the illustrative embodiment, the toner T, which is non-magnetic, is formed of styrene resin, polyester resin or similar binder resin, carbon black, dye, pigment or similar colorant, wax or similar parting agent, a charge control agent and so forth. The toner T may be produced by, e.g., pulverization or polymerization.

The toner T should preferably be chargeable to $-1\times10^{-2}$ C/kg to $-4.5\times10^{-2}$ C/kg. If the amount of charge to deposit on the toner T does not lie in such a range, then developing efficiency is lowered to result in defective images. It is to be noted that the amount of charge is controllable by varying the kinds of the constituent materials and/or by applying additives to the surfaces of the toner particles. To determine the amount of charge, use is made of a blow-off method that measures an amount of charge induced in a container by sucking toner out of 0.5 g to 1.5 g of developer together with air.

The toner T should have a volume-mean particle size of preferably between 4 μ m and 15 μm, so that the quality of images can be enhanced. The volume-mean particle size of toner may be measured with Coulter Counter Type TA-II (trade name) available from BECKMAN COULTER and an interface available from NIKKAKI BIOS K.K. for outputting a number-mean distribution and a volume-mean distribution and a personal computer CX-I (trade name) available from CANON connected to the Coulter Counter. In such a case, a 1% NaCl aqueous solution is prepared by using primary sodium chloride.

More specifically, for the measurement, 0.1 ml to 5 ml of surfactant, preferably alkylbenzene sulphonate, is added to 100 ml to 150 ml of the above electrolytic aqueous solution as a dispersant, and then 0.5 mg to 50 mg of sample is added to the solution. The resulting sample-suspended electrolyte solution is subject to dispersion in an ultrasonic dispersing apparatus for 1 to 3 minutes. Subsequently, a particle size distribution of 2μ m to 40μ m particles is measured by the Coulter Counter TA-II and an aperture of 100μm, thereby producing a volume distribution. Finally, the volume-mean particle size of toner is produced from the volume distribution.

As for the carrier particles C, which are magnetic, use may be made of particles produced by dispersing magnetite in resin as a magnetic material and then dispersing carbon black in the resulting mixture for conduction and resistance control. Alternatively, use may be made of particles produced by ferrite or similar magnetite particles whose surfaces are subject to oxidation reduction for resistance control or particles produced by coating the surfaces of ferrite or similar magnetite particles.

In the illustrative embodiment, the carrier C is so configured as to have a saturation magnetization moment of between 25 emu/g and 65 emu/g. If the saturation magnetization moment of the carrier C is smaller than 25 emu/g, then the carrier C is prevented from easily depositing on the sleeve 23*a*2, which is made of a nonmagnetic material, resulting in short image density. If the saturation magnetization moment of the carrier C is greater than 65 emu/g, then heavy compression acts on the developer being conveyed by the sleeve 23*a*2 and thereby shortens the life of the developer.

The saturation magnetization moment of the carrier C may be measured by use of an oscillating field type, automatic magnetic characteristic recorder BHV-30 available from Riken Denshi Co., Ltd. More specifically, to determine the magnetic characteristic value of carrier powder, a 0.1 T outside magnetic field is formed in order to measure the instantaneous strength of magnetization. At this instant, the carrier is sufficiently densely packed in a cylindrical plastic container. In this condition, a magnetization moment and the actual weight with the sample packed are measured to thereby produce the strength of magnetization (emu/g). Subsequently, the true specific gravity of the carrier particles is measured by a dry, automatic densitometer Accubic 1330 (trade name) available from SHIMADZU. Then, the strength of magnetization (emu/g) is multiplied by the true specific gravity to thereby determine the strength of magnetization for a unit mass (emu/g) as a saturation magnetization moment.

As stated above, in the illustrative embodiment, the magnetization of the carrier C included in the developer G is relatively weak, so that the load or compression to act on the developer G around the doctor blade 23*d* is reduced to extend the life of the developer G. Even when the magnetic attraction of the carrier C is reduced as in the illustrative embodiment, defective scoop-up of the developer G is obviated because the scoop-up pole, for example, is optimized in the illustrative embodiment, as will be described specifically later.

The weight-mean particle size of the carrier C should preferably be between 20 μm and 100 μm, more preferably between 20 μm and 70 μm. Weight-mean particle size below 20 μm would obstruct the conveyance of toner T while weight-mean particle sizes above 100 μm would reduce the fluidity or the chargeability of the developer while obstructing conveyance of the same.

The weight-mean particle size of the carrier may be measured in the same manner as the particle size of the toner stated previously. Alternatively, a plurality of sieves with different meshes may be stacked in the incrementing order as to mesh, in which case a sample whose weight is measured beforehand is put in the top sieve and classified thereby; the amount of the sample left on each of the successive sieves is measured and represented by integral percentage with respect to the total amount of the sample.

Any other material, e.g., an additive for controlling the fluidity, chargeability or similar factor of the developer may be added to the developer made up of the toner and carrier thus formed. Such an additive improves the fluidity of the developer for thereby promoting the mixture of fresh toner with the developer present in the developing device or enhances, when deposited on the toner, the parting ability of toner deposited on the drum for thereby promoting efficient image transfer.

The scoop-up pole P 3 and release pole P2, characterizing the illustrative embodiment, will be described more specifically with reference to FIGS. 4A and 4B. FIG. 4A shows flux density distributions in the direction normal to the surface of the developing roller 23, FIG. 2; concentric dashed circles indicate the flux density range up to 1000 mT on a 200 mT basis. FIG. 4B is a fragmentary enlarged view showing the scoop-up electrode P3 and its neighborhood in an enlarged scale.

As shown in FIG. 4A, the developer G is deposited on the developing roller 23*a* at the position of the scoop-up pole P3, metered to an adequate amount at the position of the doctor blade 23*d*, and then brought to a developing zone where the developing roller 23*a* faces the drum or image carrier 21. The distance or so-called doctor gap between the doctor blade 23*d* and the developing roller 23*a* is selected to be about 0.65 mm.

In the developing zone, the toner T contained in the developer G is transferred to the latent image formed on the drum 21. More specifically, the toner T is caused to deposit on the latent image by an electric field for development formed by a potential difference between the surface potential (−50 V) of the latent image formed by the laser beam L and a bias for development (−250 V) applied to the developing roller 23*a*, i.e., a developing potential. The gap between the drum 21 and the developing roller 23*a* is selected to be between 0.4 mm and 0.8 mm.

The developer G on part of the developing roller 23*a* moved away from the developing zone and therefore substantially lost the toner T is released from the developing roller 23*a* at a position between the release pole P2 and the scoop-up pole P3.

In the illustrative embodiment, the scoop-up pole P3 and release pole P2 adjoining it are of the same polarity, i.e., north pole. Therefore, the developer G can be easily released from the developing roller 23*a* even if the two poles P2 and P3 are positioned close to each other.

Further, as shown in FIG. 4B, a position Wa on the developing roller 23*a* where the flux density of the scoop-up pole P3 in the normal direction is maximum (about 400 mT) is positioned closer to the release pole P3 to the upstream side than a position Ma on the roller 23*a* that corresponds to the center Mb of a range in which the flux density of the pole P3 is halved (about 200 mT).

More specifically, assume a line W normal to the position of the scoop-up pole P3 where the flux density in the normal direction is maximum and a line M normal to the center Mb of the range in which the flux density of the pole P3 is halved. Then, in the illustrative embodiment, an arrangement is made such that the line W is closer to the release pole P2 than the line M by an angle of $\alpha$, which is selected to be 5 degrees in the illustrative embodiment.

As stated above, in the illustrative embodiment, not only a repulsive magnetic field is formed between the scoop-up pole P3 and the release pole P2, but also the position where the flux density of the pole P3 in the normal direction is maximum is positioned closer to the release pole P2. This configuration is successful to allow the scoop-up pole P3 to scoop up a relatively great amount of developer even when its overall flux density is low. In practice, the scoop-up pole P3 may be configured such that the maximum flux density in the normal direction thereof is between 35 mT and 60 mT.

The illustrative embodiment therefore prevents irregularities in density from appearing in accordance with the pitch of the first screw 23*b* due to the short amount of developer scooped up by the pole P3. Also, the illustrative embodiment prevents the developer from being scooped up in an excessive amount and accumulating around the doctor blade 23*d*, thereby freeing the developer from deterioration. It follows. that toner images can be stably formed with high quality against aging.

Figure 5:
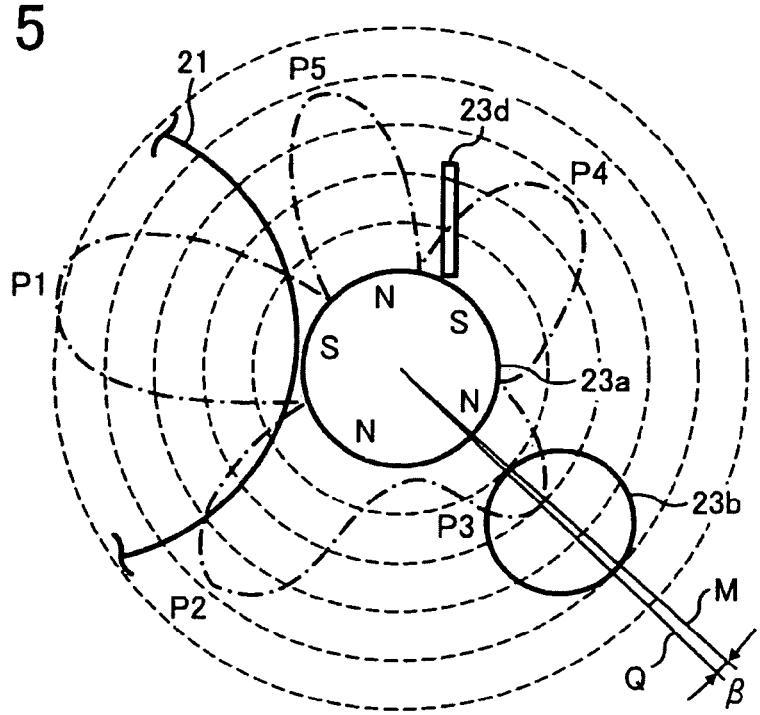
FIG. 5 shows a positional relation between the flux density distribution and a screw or conveyor member.

Further, as shown in FIG. 5, in the illustrative embodiment, the position of the scoop-up pole P3 on the developing roller 23*a* where the magnetic attraction of the pole P3 is maximum is positioned on an imaginary line Q connecting the axis of the first screw 23*b* and the axis of the developing roller 23*a*. It is to be noted that the above magnetic attraction of the scoop-up pole P3 is determined by the resultant force of the flux density in the normal direction and flux density in the tangential direction.

More specifically, assume that a line Q passing through a position on the developing roller 23*a* where the magnetic attraction of the scoop-up pole p3 is maximum and the line M passing through the center Mb of the range in which the flux density of the pole P3 in the normal direction is halved. Then, in the illustrative embodiment, the line Q is positioned closer to the release pole P2 than the line M by an angle $\beta$ (beta) which is, for example, about 3 degrees in the illustrative embodiment.

With the above configuration, it is possible to enhance efficient transfer of the developer from the first screw 23*b* to the developing roller 23*a* at the position of the scoop-up pole P3. Particularly, when the position where the flux density of the pole P3 in the normal direction is maximum is forcibly shifted toward the release pole P2 as in the illustrative embodiment, it is quite likely that the maximum flux density position in the normal direction and the maximum magnetic attraction position do not coincide with each other, so that the optimization of the maximum magnetic attraction position becomes more significant.

While in the illustrative embodiment the developing device 23 is constructed independently of the process cartridge 20, the former may be configured integrally with the latter, as desired. Further, the developing device 23 may be constructed into a unit together with at least one of the drum 21, charger 22, image transfer section 24, drum cleaner 25 and toner replenishing section 32 and removably mounted to the printer body 1. Such an alternative configuration facilitates the maintenance of the image forming section while achieving the same advantages as the illustrative embodiment.

An alternative embodiment of the present invention will be described with reference to FIG. 6 corresponding to FIG. 4A. As shown, the illustrative embodiment differs from the previous embodiment in the configuration of the flux density distribution of the release pole P2 in the normal direction.

Figure 6:
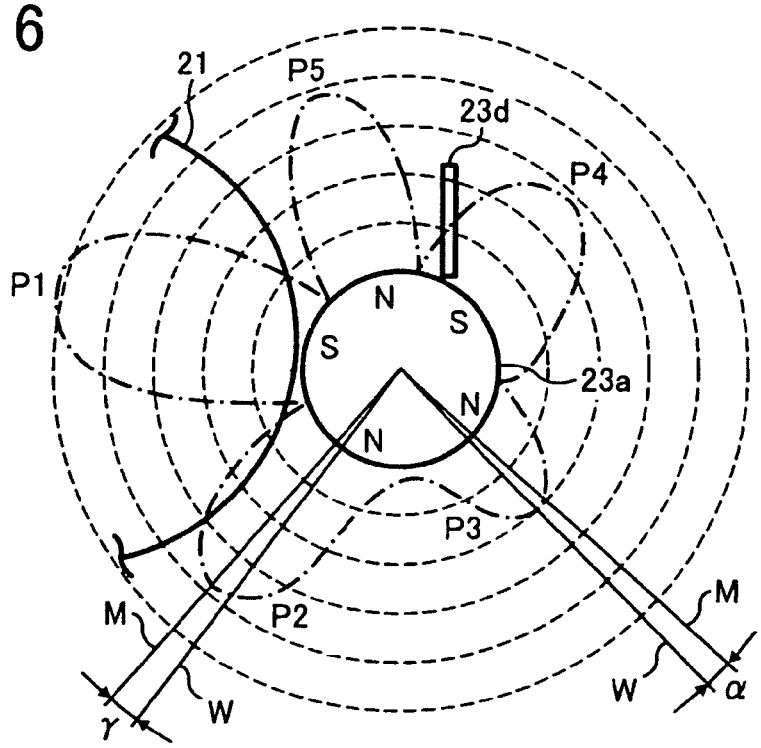
FIG. 6 is a chart showing flux density distributions representative of an alternative embodiment of the present invention.

More specifically, as shown in FIG. 6, the scoop-up pole P3 is of the same polarity as the adjoining release pole P2 (north-pole) and has the flux density distribution whose maximum value is positioned at the release pole P2 side as in the previous embodiment.

In the illustrative embodiment, a position on the developing roller 23*a* where the flux density of the release pole P2 in the normal direction is maximum (about 700 mT) is located closer to the downstream scoop-up electrode P3 than a position on the roller 23*a* where the center of the range in which the flux density of the pole P2 is halved. More specifically, assume a line W passing through the position where the flux density of the release pole P2 in the normal direction is maximum and a line M passing through the center of the range in which the above flux density is halved. Then, in the illustrative embodiment, the line W is positioned closed to the scoop-up pole P3 than the line M by an angle $\gamma$ of 3 degrees to 10 degrees, preferably 5 degrees to 10 degrees. In the illustrative embodiment, the angle $\gamma$ is selected to be 5 degrees.

As stated above, in the illustrative embodiment, the scoop-up pole P3 and release pole P2 are of the same polarity while the maximum flux density position of the pole P2 in the normal direction is located at the scoop-up pole P3 side, so that the repulsive magnetic field between the two poles P3 and P2 is intensified. Therefore, even when the two poles P2 and P3 are positioned close to each other and when the developing roller 23*a* is rotated at high speed, e.g., linear velocity as high as 350 mm/sec, the developer left on the developing roller 23*a* after development can be surely released from the roller 23*a*. This obviates an occurrence that the developer moved away from the developing zone and therefore unstable in charge is left on the developing roller 23*a* without being released and renders the resulting image density irregular.

As stated above, the illustrative embodiment optimizes the scoop-up pole P3 and release pole P2 formed on the surface of the developing roller 23*a* and thereby obviates irregular image density and other image defects and extends the life of the developer even when the developing device 23 is provided with a small size, high speed configuration. Consequently, high-quality images can be stably output against aging.

In order to confirm the advantages of the present invention, I conducted the following first to third experiments.

FIRST EXPERIMENT

Running tests were conducted with the developing device 23, i.e., the color printer 1 of the embodiment described first in order to determine whether or not the density of an output image was irregular and how much the amount of charge deposited on toner was lowered due to aging. The tests showed that no irregularities in image density ascribable to the screw pitch or defective developer release occurred despite aging and that the decrease in the amount of charge deposited on toner was reduced.

Figure 7:
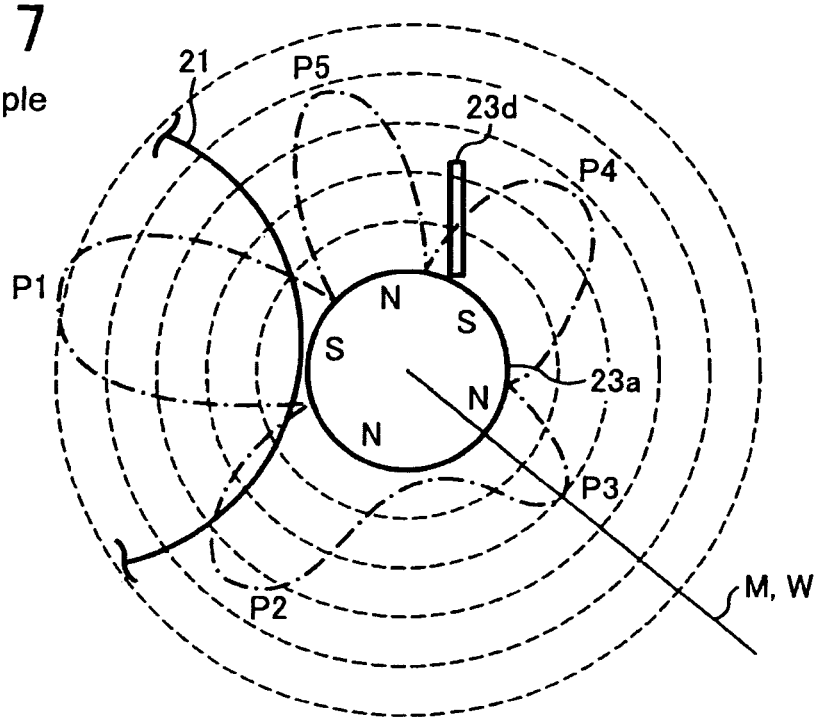
FIG. 7 shows specific flux density distributions formed when a position where the flux density of a scoop-up electrode in the normal direction is coincident with the center of a range in which the flux density is halved.

On the other hand, running tests were conducted with a developing device having flux distributions shown in FIG. 7. In FIG. 7, the line W passing through the maximum flux density position of the scoop-up pole P3 in the normal direction and the line M passing through the center Mb of the range in which the flux density is halved are coincident with each other. The tests showed that irregularities occurred in image density although the decrease in the amount of charge was reduced.

Figure 8:
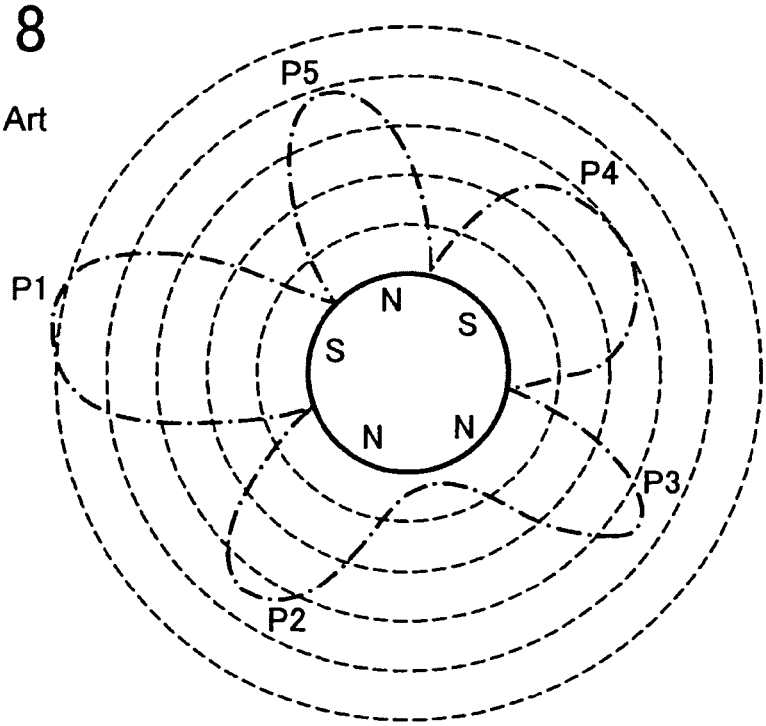
FIG. 8 Related Art
FIG. 8 shows specific flux distributions formed on a developing roller included in a conventional developing device.

Further, running tests were conducted with a conventional developing device having flux distributions shown in FIG. 8. In FIG. 8, the maximum flux density of the scoop-up pole P3 is 62 mT while the lines W and M are coincident with each other as in FIG. 7. The tests showed that the amount of charge deposited on toner was noticeably reduced and that the developer accumulated in a great amount around the doctor blade 23*d*.

SECOND EXPERIMENT

Running tests were conducted with the developing device 23 of the alternative embodiment in order to determine whether or not the density of an output image was irregular and how much the amount of charge deposited on toner was lowered due to aging. In the second embodiment, the linear velocity of the developing roller 23*a*, as measured in the developing zone, was 350 mm/sec. The tests showed that no irregularities in image density ascribable to the screw pitch or defective developer release occurred despite aging and that the decrease in the amount of charge deposited on toner was reduced. It is noteworthy that when such running tests were conducted with the embodiment described first, irregular density ascribable to defective developer release was observed.

THIRD EXPERIMENT

Running tests were conducted with the developing device of the embodiment described first and the developing device 23 shown in FIG. 7 by varying the saturation magnetization characteristic or saturation magnetic moment of the carrier C in order to check output images for image density and the decrease in the amount of charge ascribable to aging. FIG. 9 is a table listing the results of the running tests.

In FIG. 9, "EXAMPLE" refers to the running tests conducted with the embodiment stated first while "COMPARATIVE EXAMPLE" refers to the running tests conducted with the developing device of FIG. 7. Also, a circle is representative of irregular density determined to be sufficiently allowable by sensory evaluation while a triangle and a cross are respectively representative of irregular density with little margin although allowable and irregular density not allowable at all.

As FIG. 9 indicates, the embodiment described first successfully obviates irregular density if the saturation magnetization moment of the carrier C is 25 emu/g or above. Also, the decrease in the amount of charge deposited on toner decreases when the saturation magnetization moment of the carrier C is 95 emu. It follows that the carrier C should preferably be formed such that its saturation magnetization moment lies in the range of from 25 emu/g to 65 emu/g.

In summary, it will be seen that the present invention provides a developing device, a process cartridge and an image forming apparatus optimizing a scoop-up pole and a release pole formed on a developing roller and thereby obviates irregular image density and other image defects and extends the life of a developer even when the developing device is provided with a small size, high speed configuration. Consequently, high-quality images can be stably output against aging.

Various modifications will become possible for those skilled in the art after receiving the teachings of the present disclosure without departing from the scope thereof.

What is claimed is:

1. A developing device configured to develop a latent image formed on an image carrier, said developing device comprising:

a developer carrier positioned to face said image carrier and configured to allow a developer to deposit thereon, said developer carrier including a stationary magnet member configured to form on a surface of said developer carrier a scoop-up pole configured to scoop the developer stored in said developing device onto said developer carrier, wherein a release pole adjoins said scoop-up pole and is configured to release a portion of said developer that has moved away from a position where said developer carrier and said image carrier face each other from said developer carrier between said release pole and said scoop-up pole, wherein said scoop-up pole and said release pole are of a same polarity as each other, and wherein said scoop-up pole is configured such that a position where a flux density of said scoop-up pole in a direction normal to the surface of said developer carrier is maximum is located closer to said release pole than a position on said surface corresponding to a center of a range in which said flux density is halved.

2. The developing device as claimed in claim 1, wherein said release pole is configured such that a position where a flux density of said release pole in a direction normal to the surface of said developer carrier is maximum is located closer to said scoop-up pole than a position on said surface corresponding to a center of a range in which said flux density is halved.

3. The developing device as claimed in claim 1, wherein a conveyor member is positioned to face said developer carrier for conveying the developer existing in said developing device, and said scoop-up pole is configured such that a position on the surface of said developer carrier where a magnetic attraction thereof is maximum is located on a line connecting an axis of said conveyor member and an axis of said developer carrier.

4. The developing device as claimed in claim 1, wherein said scoop-up pole is configured such that the maximum flux density thereof in the direction normal to the surface of said developer carrier is between 35 mT and 60 mT.

5. The developing device as claimed in claim 1, wherein the developer comprises a two-ingredient type developer made up of a carrier and a toner.

6. The developing device as claimed in claim 5, wherein the carrier is configured such that a saturation magnetization moment thereof is between 25 emulg and 65 emulg.

7. A process cartridge including the developing device as claimed in any one of claims 1 through 6 and said image carrier constructed into a unit.

8. An image forming apparatus including the developing device as claimed in any one of claims 1 through 6 and said image carrier constructed into a unit.

* * * * *